United States Patent [19]

Carline

[11] Patent Number: 4,799,826

[45] Date of Patent: Jan. 24, 1989

[54] METHOD AND APPARATUS FOR CUTTING A SUBMERGED OBJECT INTO PIECES

[76] Inventor: Wallace Carline, 3201 Lake Palourde Dr., Morgan City, La. 70380

[21] Appl. No.: 132,031

[22] Filed: Dec. 14, 1987

[51] Int. Cl.[4] ..... B63C 11/00

[52] U.S. Cl. ..... 405/191; 405/188; 83/613; 114/65 R

[58] Field of Search ..... 405/185, 188, 190, 191, 405/173, 169; 114/221 A, 221 R, 65 R; 83/613, 614

[56] References Cited

U.S. PATENT DOCUMENTS

| | | | |
|---|---|---|---|
| 34,116 | 1/1862 | McCluskey . | |
| 1,469,574 | 10/1923 | Allan | 405/191 |
| 2,555,069 | 5/1951 | Verney | 83/613 |
| 3,822,660 | 7/1974 | Throner, Jr. . | |
| 4,016,728 | 4/1977 | Mason | 405/191 |
| 4,084,528 | 4/1978 | Itani et al. | 114/65 R X |
| 4,215,544 | 8/1980 | Stanwick | 405/191 X |
| 4,307,679 | 12/1981 | Goldsberry et al. . | |

*Primary Examiner*—Dennis L. Taylor
*Attorney, Agent, or Firm*—Burns, Doane, Swecker & Mathis

[57] ABSTRACT

A submerged object, such as a barge, is cut into pieces by a cutting apparatus suspended from a floating vessel. The apparatus comprises a blade carrier which forms channels in which a cutting blade is mounted for vertical movement. In practice, the blade carrier includes a pair of pointed anchor studs at the lower end thereof. The blade carrier is suspended above the submerged barge and is dropped thereon so that the anchor studs are impaled in the barge to hold the carrier in positionally constrained relationship therewith. Thereafter, the cutting blade is dropped onto the barge while the carrier is positionally constrained relative to the barge by the anchor studs. By repeated performance of those steps, a series of aligned cuts can be made through the object in order to divide the object into separately raisable pieces.

31 Claims, 4 Drawing Sheets

Fig. 5
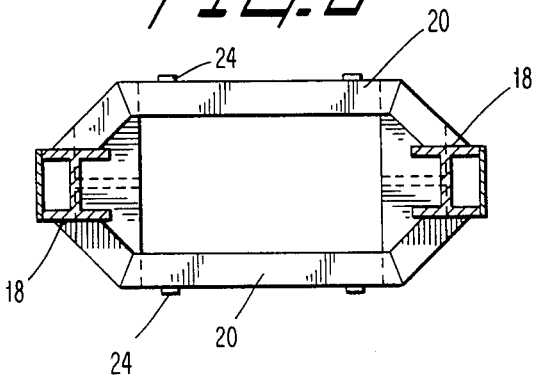
Fig. 6
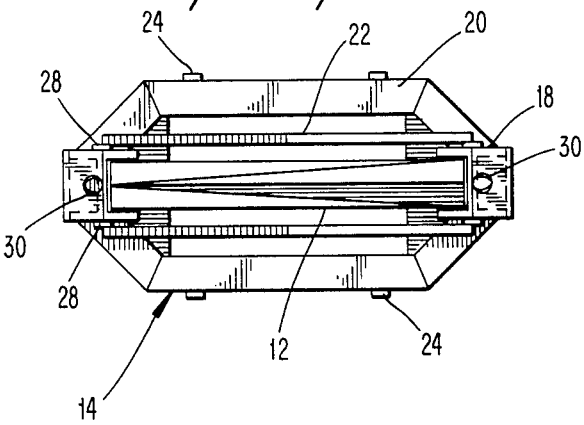
Fig. 7
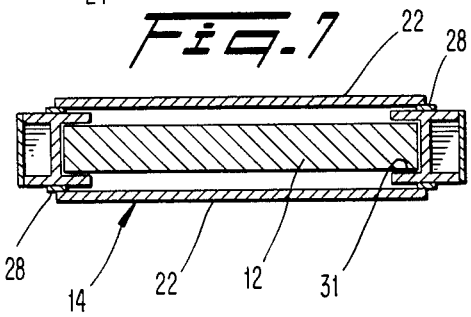
Fig. 9
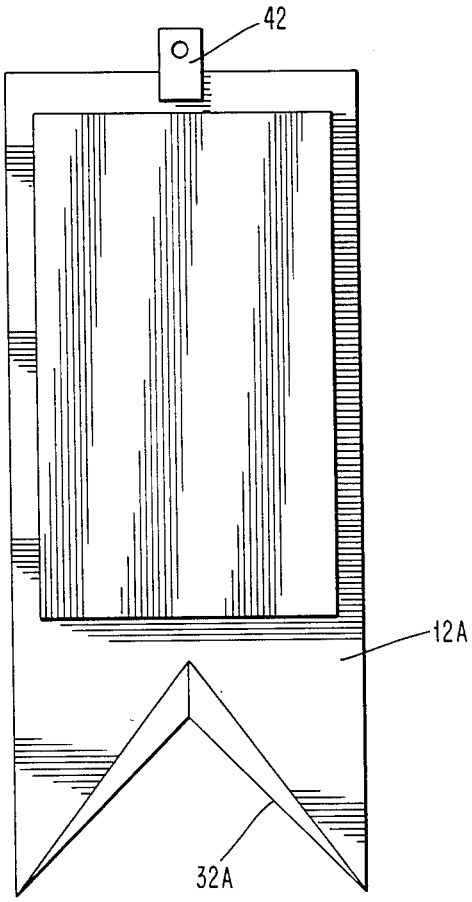
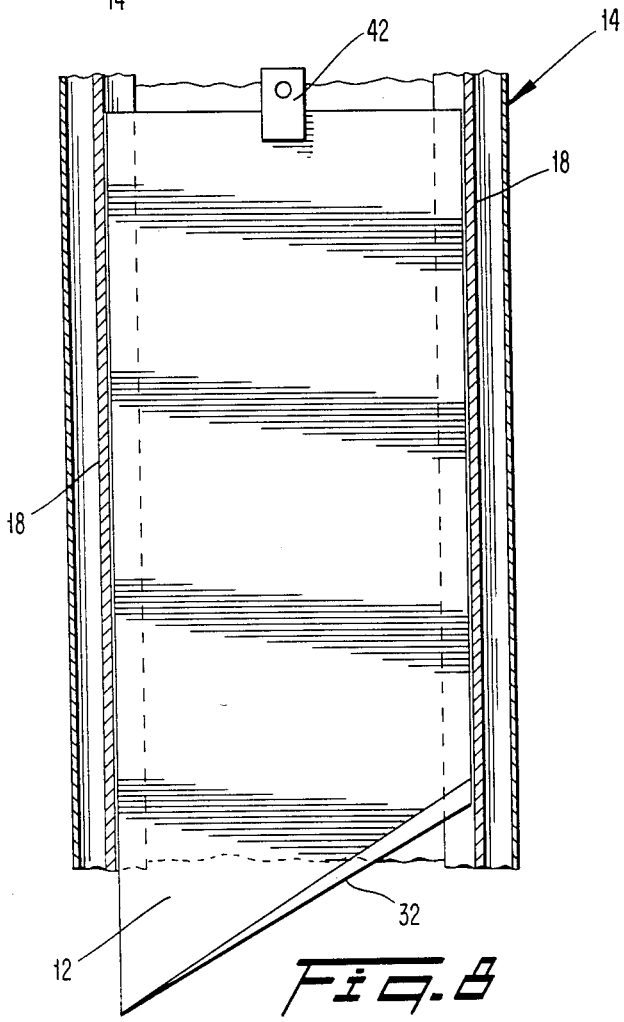
Fig. 8

METHOD AND APPARATUS FOR CUTTING A SUBMERGED OBJECT INTO PIECES

BACKGROUND OF THE INVENTION

The present invention relates to the cutting and raising of submerged objects such as barges.

Lying at the bottom of many waterways, such as rivers, are submerged artificial structures which can obstruct marine navigation. Among those structures, for example, are barges which have been intentionally or accidentally sunk. Intentional sinkings have resulted from conventional techniques of erecting offshore well drilling platforms in which the platforms are floated on barges to an offshore site, whereupon the barges are sunk as a part of the platform-erecting process.

Raising of the submerged structures in one piece can be extremely difficult, especially if the structure is filled with mud and water, as is usually the case with submerged barges for example. Therefore, one practice involves raising the structure piecemeal by cutting the structure into smaller, lighter pieces. Attempts to accomplish this by divers equipped with welding torches has proved to be tedious and expensive.

Other attempts to break-up a submerged structure have included the practice of repeatedly dropping a heavy impact member such as an I-beam onto the submerged structure. The impact member contained a pointed bottom edge to facilitate a penetration of the submerged structure. The impact member, being unguided in its descent, struck the submerged structure at random locations, whereby considerable time and effort was required to break up the submerged structure.

Therefore, it would be desirable to provide methods and apparatus for facilitating and economizing the cutting and raising of submerged structures.

SUMMARY OF THE INVENTION

These objects are achieved by the present invention which relates to methods and apparatus for cutting a submerged object, such as a barge, into pieces. The apparatus comprises a blade carrier which includes a vertical guide, downwardly projecting anchors, and a suspension device for enabling the carrier to be suspended over the submerged object so that the carrier can be impacteded against the object in a manner causing the anchors to engage the object in positionally constrained relationship therewith. A cutting blade is mounted in the guide for vertical movement relative to the carrier. The blade includes a lower cutting edge and means for causing the blade to impact downwardly against the object to cut the object while the carrier is positionally constrained relative to the object by the anchors.

A method aspect of the invention comprises the steps of suspending over the object a blade carrier having a vertical guide in which a blade is mounted for vertical movement relative to the carrier. The carrier is caused to impact downwardly against the object so that downwardly projecting anchors on the carrier engage the object in positionally constrained relationship therewith. The blade is caused to travel downwardly relative to the carrier such that a lower cutting edge of the blade impacts and cuts through the object while the carrier is positionally constrained relative to the object by the anchors.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 5 is a cross-sectional view taken along the line 5—5 in FIG. 3;

FIG. 6 is an end view of the blade carrier taken in the direction of the line 6—6 in FIG. 3;

FIG. 7 is a cross-sectional view taken along the line 7—7 in FIG. 3;

FIG. 8 is a front elevational view of a portion of the blade carrier, with a portion thereof removed to expose the cutting blade;

FIG. 9 is a front elevational view of an optional form of cutting blade;

DETAILED DESCRIPTION OF A PREFERRED EMBODIMENT OF THE INVENTION

Figure 1:
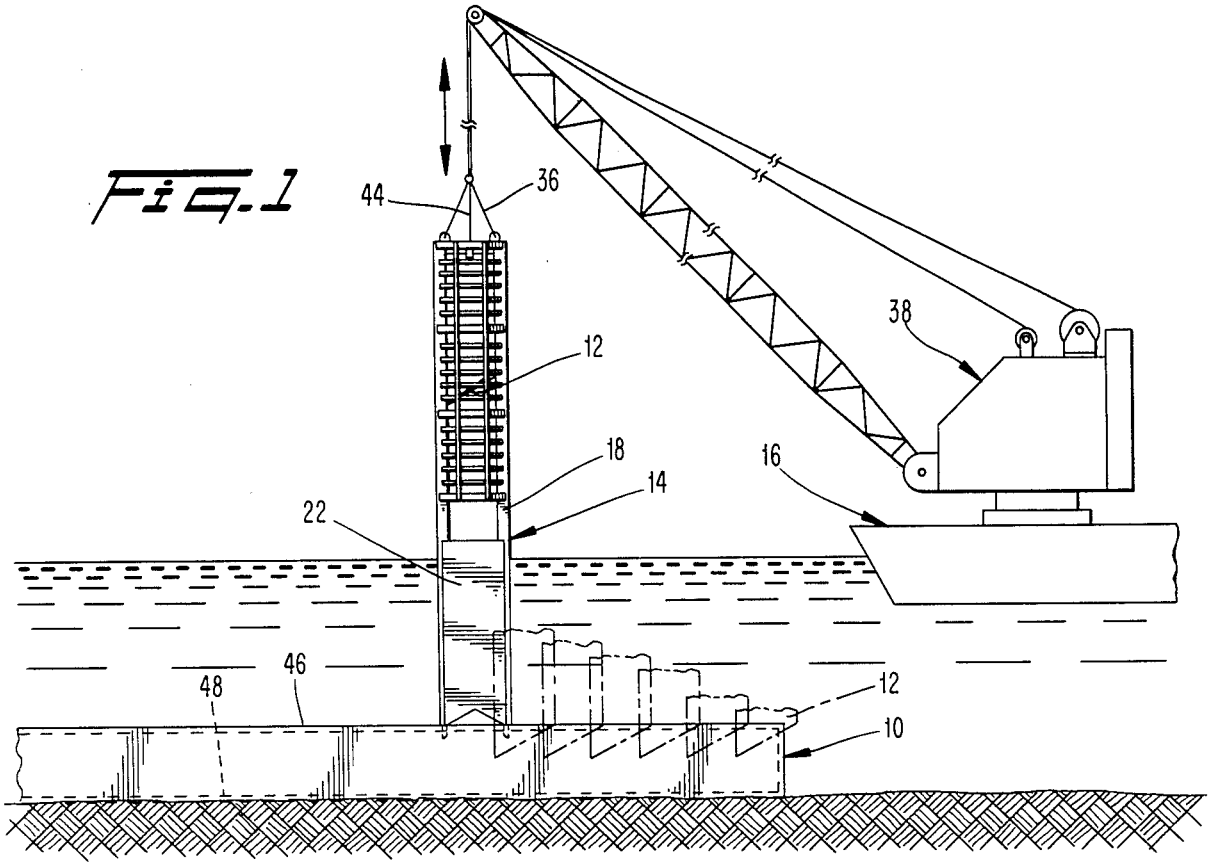
FIG. 1 is an elevational view of a vessel-mounted cutting element according to the present invention in the process of cutting a submerged barge, with various cutting positions of the cutting blade depicted in phantom lines as they cut through a top deck plating of the submerged barge.
Figure 2:
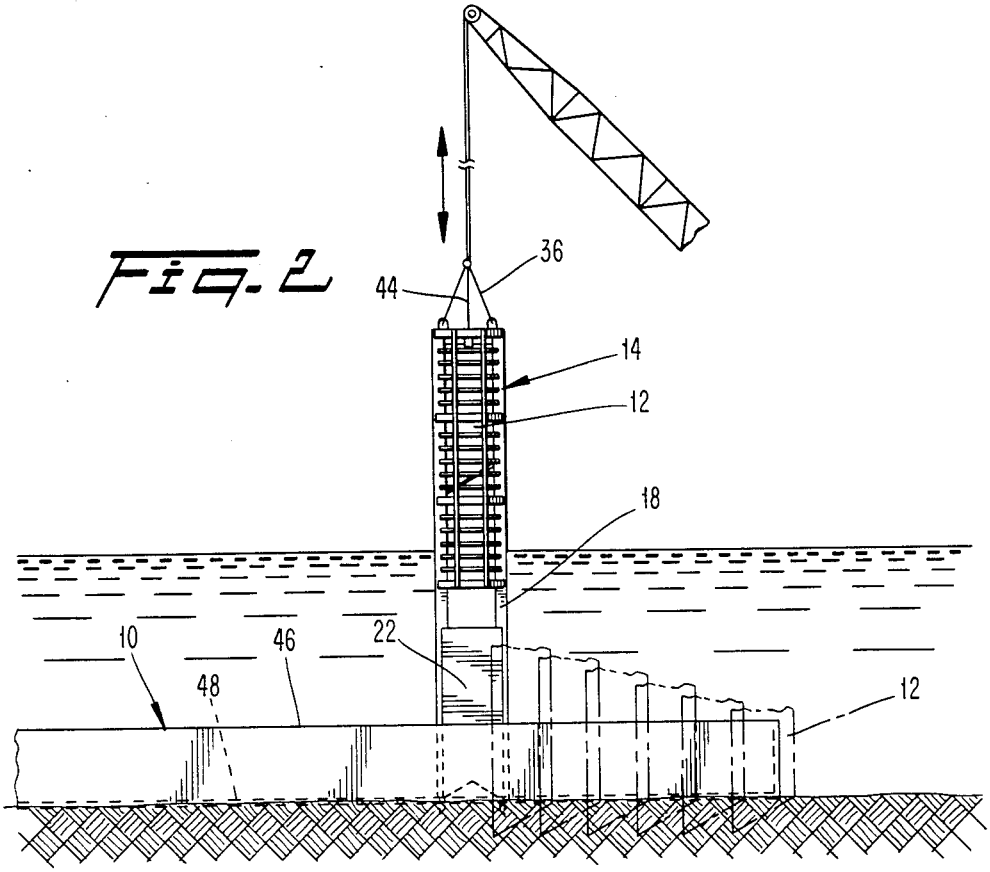
FIG. 2 is a view similar to FIG. 1 as the cutting mechanism cuts through a lower deck plating of the submerged barge.
Figure 3:
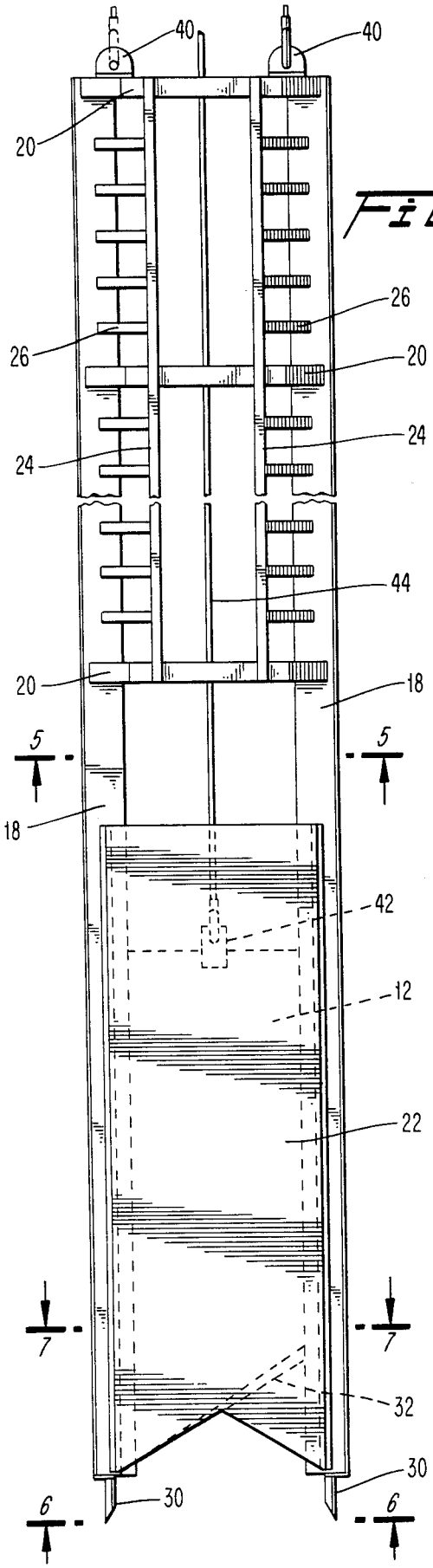
FIG. 3 is a front elevational view of a blade carrier according to the present invention.
Figure 4:
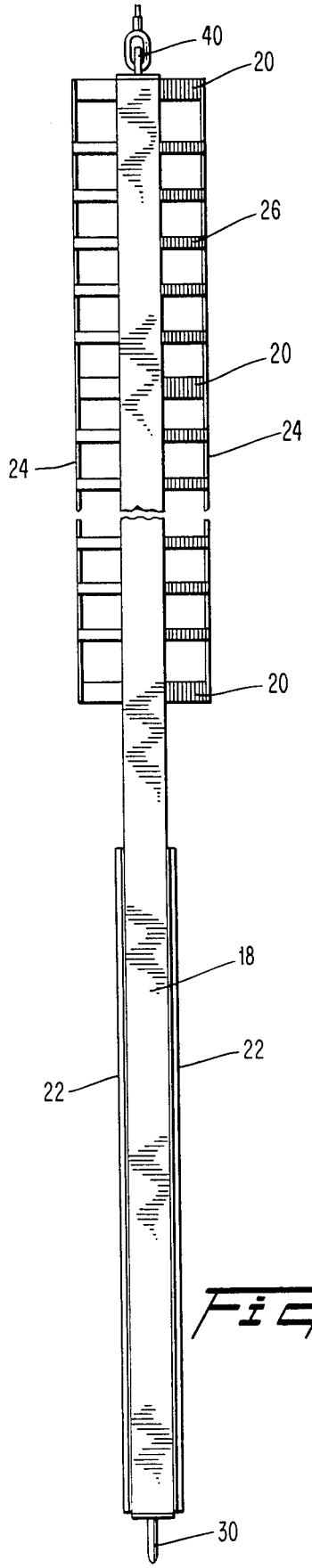
FIG. 4 is a side elevational view of a blade carrier depicted in FIG. 3.

Depicted in FIG. 1 is a submerged object in the form of a submerged barge 10 which is to be cut into pieces in accordance with the present invention. The cutting is to be performed by a cutting blade 12 guided for vertical travel in a carrier 14 that is supported from a floating vessel 16. The guide member 14 engages the barge in a positionally fixed manner before the blade is dropped. Sequential cuts made in that manner are aligned to form a defnied cut line. Accordingly, the barge is eventually cut into pieces which are individually raised.

Referring now to more specific aspects of a preferred embodiment of the invention, the carrier 14 comprises a pair of vertical guide legs each of which comprises a steel H-beam (see FIG. 5). The legs are rigidly interconnected by various support members including a plurality of cross-members 20 and a pair of plates 22. The cross-members 20 are vertically spaced apart and have their ends affixed to respective legs 18, e.g., by welding. The cross members 20 are interconnected by vertical bars 24 which are connected directly to the legs by vertically spaced strips 26.

The plates 22 are preferably formed of a heavy material such as iron or steel, and are affixed to vertical bars 28 (FIG. 7) which, in turn, are affixed to respective legs 18. The plates 22 serve to interconnect the legs 18, as well as to add weight to the carrier 14 for reasons which will become apparent.

Projecting from lower ends of the legs 18 are sharpened anchoring studs 30, preferably formed of high-strength material such as iron and steel. The anchoring studs 30 may be welded to lower ends of the legs 18.

The blade 12 is slidably mounted in mutually opposed channel portions 31 of the H-beams (see FIG. 7). The blade includes a pointed lower edge 32 and should be heavy. For example, the blade 12 could be formed of a steel plate having a thickness of at least five, preferably seven inches, a width of about four to six feet, a height of about six to eight feet, and a weight of at least 5,000 pounds, preferably more than 10,000 pounds. A blade of seven inches in width and weighing 12,000 pounds has been successfully employed.

The carrier 14 can be suspended by a cable 36 from a crane 38 disposed on the floating vessel 16. For that purpose the carrier includes a plurality of lifting eyes 40 welded to the uppermost cross-member 20. The blade includes a lifting eye 42 by means of which the blade can be suspended from a cable 44 of the vessel-mounted crane. Accordingly, the blade 12 can be raised and lowered relative to the carrier 14.

In practicing the present invention, the outline of the submerged barge 10 is determined in any suitable manner, e.g., by the use of a conventional aluminum sounding pole manipulated from the floating barge. When the barge outline has been determined, buoys (not shown) are attached to the corners of the submerged barge by conventional anchor lines to mark the outline.

The carrier 14 is then suspended from the crane over the submerged barge at a position where a first cut is to be made. The carrier 14 is released and allowed to free fall until the anchor studs 30 penetrate the upper deck plating 46 of the submerged barge as depicted in FIG. 1. As a result, the carrier is engaged with the submerged barge 10 in positionally constrained relationship therewith by means of the impaled studs. During the free fall of the carrier 14, the blade 12 is held in position and thus is now located at or near the top of the carrier. The blade 12 is then released and permitted to free fall against the upper deck plating 46 of the submerged barge, while the carrier 14 is positionally stabilized by the studs 30. Due to the considerable weight of the blade, the cutting edge 32 penetrates that plating 46 and forms a gash therein. The blade is guided during the fall by the carrier which, in turn, is restrained against lateral displacement by the studs 30.

The carrier 14 and blade 12 are then raised by the crane and the carrier is moved horizontally in the plane of the gash by a selected distance. That distance can be slightly less than the width of the gash so that a subsequent cut will overlap the previous cut. During this movement, the crane operator can locate the previously cut gash by "feeling" the engagement of the anchoring studs within the previously cut gash. When the carrier has been properly positioned at its next cut site, it is raised and dropped in the previously described manner. This time, one of the anchoring studs 30 will penetrate the plating 46 of the submerged barge and the other stud will enter the previously made gash and will be positioned by its engagement therein. Then, the blade 12 is dropped to make another gash aligned with the previous gash.

This procedure is continued as depicted in FIG. 1 to form a cut line along the plating. Thereafter, the procedure is repeated along the lower deck plating 48 (the carrier and blade will travel through the previously-made cut line in the upper plating) until a piece of the barge has been completely severed from the rest of the barge. A series of parallel cut lines can be made in that manner, followed by a series of parallel cut lines perpendicular to the first series until the barge has been cut into smaller pieces. Once the desired number of pieces have been formed, they can be individually raised by a clam bucket manipulated from the crane.

Depending upon the nature of the cut being made, different types of blades may be employed. For example, when cutting through flat plating, a blade 12 is employed which has a linear sloping cutting edge 32 as depicted in FIG. 8. On the other hand, when cutting a large, bulky object such as an I-beam, there would be employed a blade 12A having an inverted V-shaped cutting edge 32A, (see FIG. 9). The latter edge 32A will tend to become self-centered onto such an object upon being dropped thereon, whereas, a straight sloping edge could tend to be deflected laterally off the object.

Figure 10:
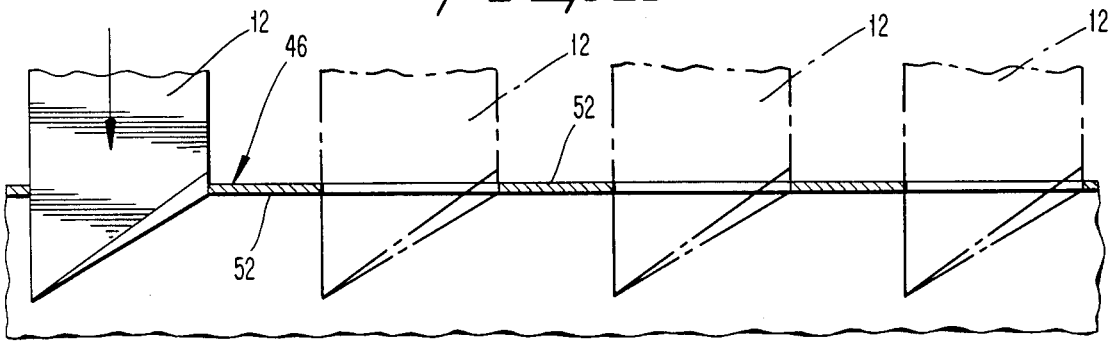
FIG. 10 is a view depicting the manner in which the blade of FIG. 8 cuts through the top deck plating of a submerged barge.
Figure 11:
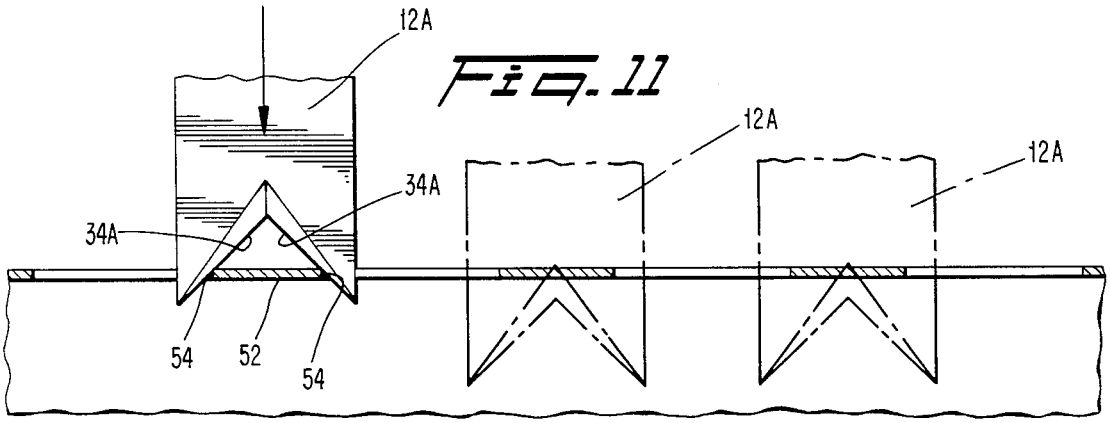
FIG. 11 is a view similar to FIG. 10 depicting the manner in which the blade of FIG. 9 cuts through uncut portions remaining after the cutting operation depicted in FIG. 10.
Figure 12:
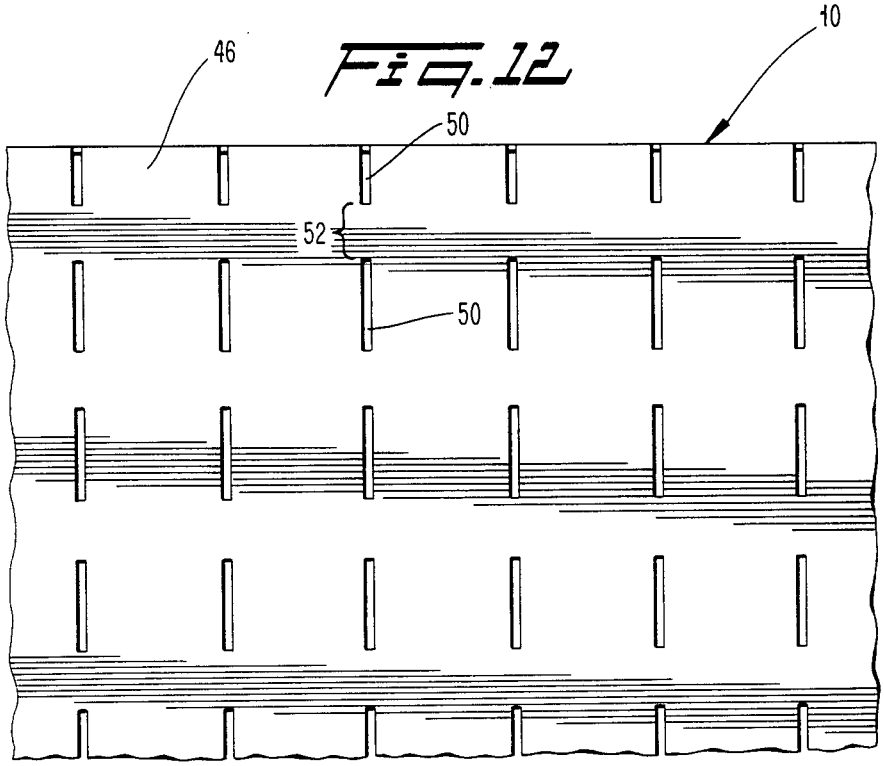
FIG. 12 is a plan view of the top deck plating of the submerged barge, depicting one pattern of cuts formed therein.

The inverted V-cutting edge 32A also makes it possible to form a cut line in a non-overlapping fashion, rather than in the afore-described overlapping manner in which the gashes overlap one another. That is, initial gashes 50 can be made by the blade 32 in horizontally spaced relationship to the previous gash as depicted in FIGS. 10 and 12, leaving segments 52 of the plating uncut between adjacent gashes. Those uncut segments 52 can later be cut by employing the inverted V-shaped cutting edge 32A since that cutting edge 32A will tend to become self-centered upon the uncut segment when dropped thereon, due to engagement of the cutting edge portions 34A with the ends 54 of the uncut segment (see FIG. 11).

It will also be appreciated that the inverted V-shaped blade can also be employed in that manner to sever any uncut segments which accidentally may remain following an overlapping type of cut.

It will be appreciated that the cutting methods and apparatus described above enable a submerged object such as a barge to be cut into pieces in a systematic manner which greatly minimizes the time and effort involved.

Although the present invention has been described in connection with a preferred embodiment thereof, it will be appreciated by those skilled in the art that additions, substitutions, modifications and deletions not specifically described may be made, without departing from the spirit and scope of the invention, as defined by the appended claims.

What is claimed is:

1. Apparatus for cutting a submerged object such as a barge into pieces, comprising:

a floating vessel carrying a cable, a blade carrier including vertical guide means, anchor means projecting downwardly from a lower end of said carrier, and suspending means for suspending said carrier from said cable over the submerged object so that said carrier can be impacted against the object in a manner causing said anchor means to engage the object in positionally constrained relationship therewith, a cutting blade mounted in said guide means for vertical movement relative to said carrier, said blade including a lower cutting edge, and blade-actuating means for causing said blade to impact downwardly against the object to cut the object while said carrier is positionally constrained relative to the object by said anchor means, said blade actuating means including means for repeatedly raising said blade and allowing said blade to free fall, and cable actuating means carried by said vessel for actuating said cable to relocate said blade carrier relative to said object for enabling repeated downward free-fall impacting of said cutting edge to make a cut line across the object which separates said object into separately salvageable pieces.

2. Apparatus according to claim 1, wherein said anchor means comprises a plurality of pointed anchor studs.

3. Apparatus according to claim 2, wherein said anchor studs are positioned adjacent opposite ends of a blade-guiding path defined by said guide means.

4. Apparatus according to claim 1, wherein said carrier comprises a pair of horizontally spaced vertical guide legs defining said guide means, vertical ends of said blade mounted in respective ones of said guide means.

5. Apparatus according to claim 4, wherein said guide means comprise mutually opposed vertical channels.

6. Apparatus according to claim 1, wherein said suspending means comprises lifting eyes for receiving said cable.

7. Apparatus according to claim 6, wherein said blade includes a lifting eye for receiving an additional cable.

8. Apparatus according to claim 1, wherein said cutting edge comprises a single linear sloping edge.

9. Apparatus according to claim 1, wherein said cutting edge is of inverted V-shape.

10. Apparatus according to claim 1, wherein said cutting edge comprises a pointed hardened surface.

11. Apparatus according to claim 1, wherein said blade weighs at least 5,000 pounds.

12. Apparatus according to claim 1, wherein said blade weighs at least 10,000 pounds.

13. Apparatus according to claim 1, wherein said blade is at least 5 inches thick adjacent said cutting edge.

14. A method of cutting a submerged object such as a barge into pieces, comprising the steps of:

(A) suspending over said object a blade carrier having vertical guide means in which a blade is mounted for vertical movement relative to said carrier, (B) causing said carrier to impact downwardly against said object so that downwardly projecting anchor means on said carrier engages said object in positionally constraining relationship therewith, (C) causing said blade to travel downwardly relative to said carrier such that a lower cutting edge of said blade impacts and cuts through said object while said carrier is positionally constrained relative to said object by said anchor means, and (D) moving said carrier across said body and repeatedly causing said blade to cut through said object as described by step C to form a cut line across said object which separates said object into separately salvageable pieces.

15. A method according to claim 14, wherein step D comprises the steps of raising said carrier and blade out of positionally constrained relationship with said object, repositioning said carrier horizontally in the direction of said cutting edge, and repeating said two causing steps to form a second cut in said object substantially aligned with said first-named cut.

16. A method according to claim 15, wherein said blade cuts through said object by means of a single linearly sloped cutting edge.

17. A method according to claim 16, wherein said second cut overlaps said first-named cut.

18. A method according to claim 16, wherein said second cut is spaced from first-named cut to leave an uncut portion therebetween, and further comprising the step of repeating step C utilizing a blade having an inverted V-shaped cutting edge which cuts said uncut portion.

19. A method according to claim 16, wherein during step B said anchor means impales said object to create said positionally constrained relationship.

20. A method according to claim 16, wherein said anchor means enters previously made cuts in said object to create said positionally constrained relationship.

21. A method according to claim 16, wherein step B comprises dropping said carrier onto the object so that anchor means in the form of two pointed anchor studs engage said object.

22. A method according to claim 16, wherein step A comprises suspending said carrier from a floating vessel.

23. Apparatus according to claim 4, wherein said guide legs comprise solid metal beams.

24. Apparatus according to claim 4, wherein said cutting edge extends across at least a substantial portion of the spacing between said guide legs.

25. Apparatus according to claim 24, wherein said cutting edge extends across the entire spacing between said guide legs.

26. Apparatus according to claim 1, wherein said cutting edge is oriented at an acute angle relative to the direction of downward travel of said blade, whereby said cutting edge cuts progressively through said object during a stroke of said blade.

27. A method according to claim 14, wherein step B comprises the step of allowing said carrier to free-fall downwardly such that downward forces resulting solely from gravity act on said anchor means to cause said anchor means to penetrate said object.

28. A method according to claim 14, wherein step A comprises suspending a blade carrier which includes two horizontally spaced, solid metal beams oriented vertically over said object.

29. A method according to claim 14, wherein said carrier includes two horizontally spaced vertical guide legs, step C including the step of causing said blade to travel downwardly relative to said guide legs while said cutting edge extends for at least a substantial portion of the spacing between said guide legs.

30. A method according to claim 14, wherein said step C includes causing said blade to travel downwardly such that a cutting edge disposed at an acute angle relative to the direction of blade downward travel cuts progressively through said object during a blade stroke.

31. A method of cutting a submerged object into pieces, comprising the steps of:

(A) floating a vessel above said object, said vessel carrying first and second independently movable cables and cable actuating means for said first and second cables, (B) suspending from said first cable a blade carrier having a pair of horizontally spaced vertical guide means in which a blade is mounted for vertical movement relative to said carrier, said blade being connected to said second cable, (C) actuating said first cable in a manner causing said carrier to descend, whereby lower ends of said guide means engage said object in positionally constraining relationship therewith, (D) actuating said second cable in a manner causing said blade to travel downwardly relative to said carrier such that a lower cutting edge of said blade, which extends across at least half the distance between said guide means, cuts through said object in a manner separating said object into separate pieces, said cutting edge disposed at an acute angle relative to the direction of downward travel of said blade, whereby said cutting edge cuts progressively through said object during a stroke of said blade.

* * * * *